United States Patent [19]

Axelrod

[11] 4,118,823

[45] Oct. 10, 1978

[54] HAIR BRUSH

[75] Inventor: Jerome Axelrod, New York, N.Y.

[73] Assignee: Jerome Alexander Cosmetics, Inc., New York, N.Y.

[21] Appl. No.: 779,184

[22] Filed: Mar. 18, 1977

[51] Int. Cl.[2] ..... A46B 7/00; A46B 9/02

[52] U.S. Cl. ..... 15/176; 15/186; 15/202; 132/11 R

[58] Field of Search ..... 15/110, 184, 186–188, 15/201–203, 398–400, 197, 199, 204; 132/85, 123, 9, 11, 118; 401/201

[56] References Cited

U.S. PATENT DOCUMENTS

| | | | |
|---|---|---|---|
| 301,644 | 7/1884 | Thompson | 15/186 X |
| 403,542 | 5/1889 | Loonen | 15/199 |
| 795,062 | 10/1903 | Pollmann | 15/197 |
| 1,878,323 | 9/1932 | Quist | 15/197 |
| 3,962,742 | 6/1976 | Vendur | 15/201 |
| 4,023,230 | 5/1977 | Freidman et al. | 15/169 |
| 4,030,158 | 6/1977 | Blair | 15/186 X |
| 4,034,435 | 7/1977 | Grabathy | 15/398 |

FOREIGN PATENT DOCUMENTS

| | | | |
|---|---|---|---|
| 24,488 | 5/1919 | Denmark | 15/191 R |
| 453,104 | 5/1913 | France | 15/199 |
| 944,767 | 11/1948 | France | 15/186 |
| 510,731 | 8/1939 | United Kingdom | 15/202 |
| 863,723 | 3/1961 | United Kingdom | 15/202 |

*Primary Examiner*—Daniel Blum
*Attorney, Agent, or Firm*—Bierman & Bierman

[57] ABSTRACT

A hair brush having bristles extending from openings extending through a cushion on the base of the hair brush is disclosed. The openings allow a flow of air from a hand-held hair dryer or blower to reach the hair and scalp during brushing. The brush has a handle, a base connected to the handle, and vents running through the base. Bristles are mounted on a long, narrow, substantially rectangular track. The track is affixed to the base so that the bristles extend from the openings. The openings are wider than the tracks and bristles to allow a flow of air to pass through.

9 Claims, 7 Drawing Figures

HAIR BRUSH

BACKGROUND OF THE INVENTION

In our modern day and age, elaborately styled hair has become very popular for both men and women in this country. The cost of having one's hair styled is not inexpensive but people today are more concerned with their appearance. Thus, people have become very concerned with impeccably maintaining their hair to the greatest extent they can between visits to the expensive hair cutting shops.

Usually, maintaining these hairstyles requires frequent washing of the hair with special shampoos and then simultaneous brushing and blow-drying the hair with a hand-held blower or dryer. Simultaneous blowing and brushing is necessary to bring out the body of the hair and restore the style which has been designed with the individual's own hair type and head shape in mind.

Hence the hair brush, and particularly hair brushes designed for styling, have become very popular in recent years. One problem observed is that the hair brushes block the flow of air to the scalp and hair being brushed when they are used in conjunction with a hair blower or dryer. In addition, with frequent use, these brushes become dirty very quickly and require regular cleaning. It is the object of applicant's invention to solve both of these problems by providing a hair brush that does not block the flow of air when used with a hand-held hair blower or dryer and yet is easy to clean on a regular basis. A further object of the invention is to provide a hair brush that is inexpensive to manufacture and offers flexibility of design, i.e., can practically be adapted to the low, medium or high priced market using the same design.

GENERAL DESCRIPTION OF THE INVENTION

Applicant's invention is a hair brush that will allow a flow of air from a conventional hand-held hair dryer or blower to reach the scalp and hair to facilitate both drying and styling. The hair brush comprises a handle, and a base. The base is connected to the handle and bristles extend from a plurality of openings extending through a cushion on the base. Apertures that are at least as narrow as the bristles are provided adjacent the openings. The bristles are upstanding and are mounted parallel to each other on a long, narrow track having a substantially rectangular cross-section. This track, in turn, is affixed to the base so that the bristles will extend through the apertures and the openings. These openings are larger than the bristles and track so that air passing through the openings will not be blocked. The narrow apertures will tend to grip the bristles (which are affixed to the track) and hold them and the track in place.

The track is an elastomeric or flexible material that is stiff enough to support the bristles. The bristles may be made from substantially the same material or a different material. They can, for example, be plastic or any other material well-known in the art that will provide suitable stiffness and control of the hair strands. The distance between the bristles on the track will be known to those who are skilled in the art and depend upon many parameters; such as the type of bristle selected, thickness of the hair to be brushed, and styling effect sought to be achieved. It will be appreciated that each track used will provide one row of bristles. The number of tracks ultimately selected for a brush will also vary with the type of bristles used, the particular hair involved, etc. Moreover, the tracks may be set in the base so that the bristles will present a curved face, a flat face or any other shaped face desired, depending upon the use to which the brush is to be put. One of ordinary skill in the art could easily ascertain these design parameters for the various types of hair and styling effects desired.

In a preferred embodiment, an elastomeric or soft rubber cushion is mounted on the base and the brush face is on the cushion. The cushion has a plurality of interior chambers and the track or tracks are mounted therein and in the aforementioned apertures and openings. This cushion forms pads that fold under the face and resiliently press the tracks and, in turn, bristles toward the brush face. Thus, the tracks and bristles are resiliently supported in the base of the brush and it will give a firm but flexible and gentle massage to the hair and scalp during brushing.

It is most preferred that the cushion be detachable from the rest of the base. This may be accomplished by in-turning peripheral portions of the non-cushioned portion of the base so as to provide a retaining runway along which the cushion is slidably removable. Of course, other methods of removably attaching the cushion to the remainder of the base will occur to those of ordinary skill in the art.

A detachable cushion provides tremendous flexibility for the design and marketing of these brushes. For example, a manufacturer can make many different quality lines of basically the same brush by using the same bristles, tracks and cushions and merely changing the material used to make the remainder of the base and handle. Alternatively, different quality bristles may be substituted in the different models while using the same cushion and remainder of the brush. Further, the other part of the base that grips the cushion and handle can be made cheaply out of plastic for the inexpensive market or out of wood, metal, gold or silverplate, mother-of-pearl inlay and even gem stones for the smaller, more expensive high end market which requires a fancier or more decorative brush.

From the ultimate user's standpoint, this design is desirable because the cushion and bristle combination can be easily detached for cleaning. When an expensive but non-washable base and handle are involved, this is of the utmost importance. Even when the entire brush is washable, the detachable feature permits more thorough cleaning. Consequently, this brush can be made both functional and attractive.

An important advantage of providing chambers within the cushion is that air from the hand-held blower or dryer will tend to collect therein and be more evenly distributed in streams out of the face of the brush even when the stream of air is misdirected and hits only a small portion of the chamber. The wider and more even air flow that results, the better the styling and drying action.

The chambers also make it much easier to give the interior of the cushion and tracks a thorough cleaning without removing the cushion when the remainder of the brush is made of a washable material. Without the chambers, they would be inaccessible unless the brush were disassembled.

The foregoing and other objects and advantages of the invention, as well as the basic characteristics thereof, including equivalents and substitutions therefor are better understood by giving consideration to the detailed description to the embodiment of the invention shown. In the accompanying drawings, in which like reference characters indicate like parts, FIG. 1 is a perspective view showing the most preferred embodiment of the invention wherein the base comprises a detachable cushion;

Figure 1:
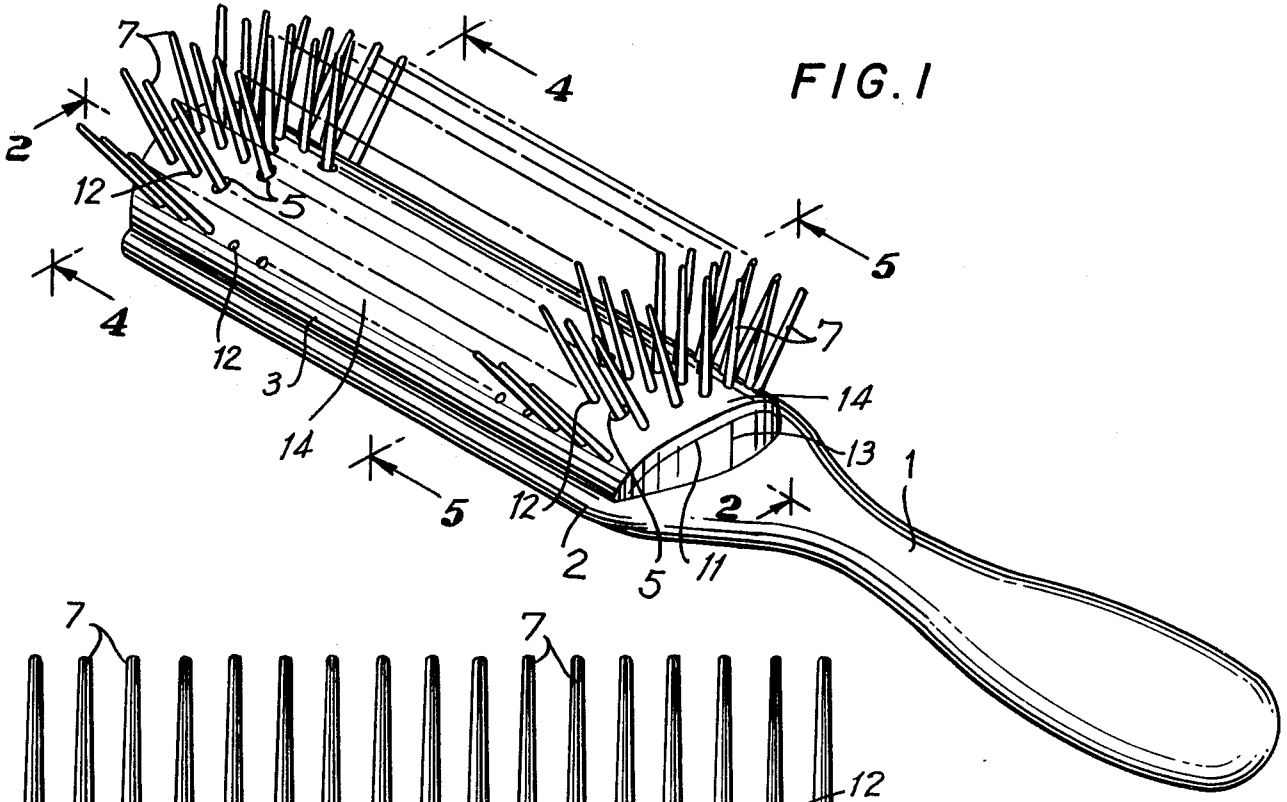
Figure 2:
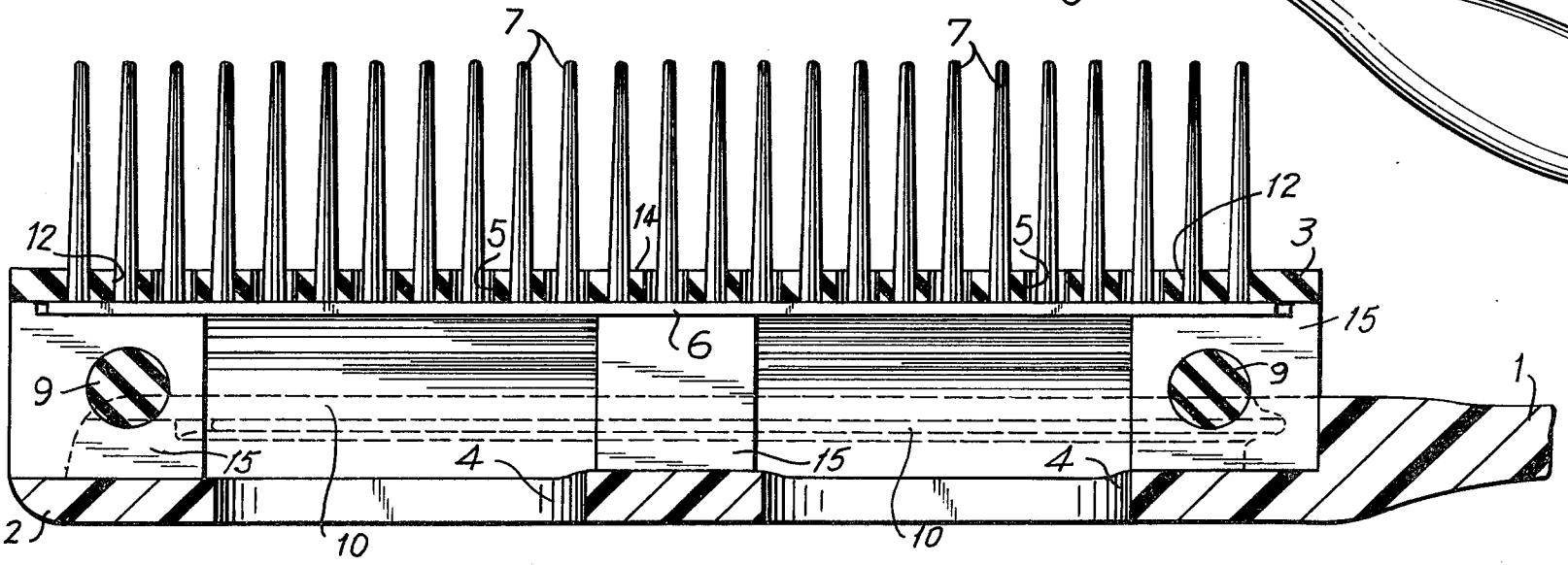
FIG. 2 is a vertical, longitudinal cross-section along lines 2—2 of FIG. 1.

Referring now to FIGS. 1–7, handle 1 is connected to base 2 having cushion 3 and brush face 14 thereon. Cushion 3 has chambers 10 therein as well as openings 5 and apertures 12. The bristles 7 are mounted on tracks 6. This is most clearly seen in FIGS. 6 and 7.

Openings 5 in the cushion 3 are larger than either the aforementioned bristles or tracks so that air passing into chambers 10 will not be blocked from moving through openings 5 out past brush face 14. However, apertures 12 in cushion 3 are no larger than bristles 7 so that cushion 3 will grip bristles 7 and maintain them and tracks 6 in place.

Figure 4:
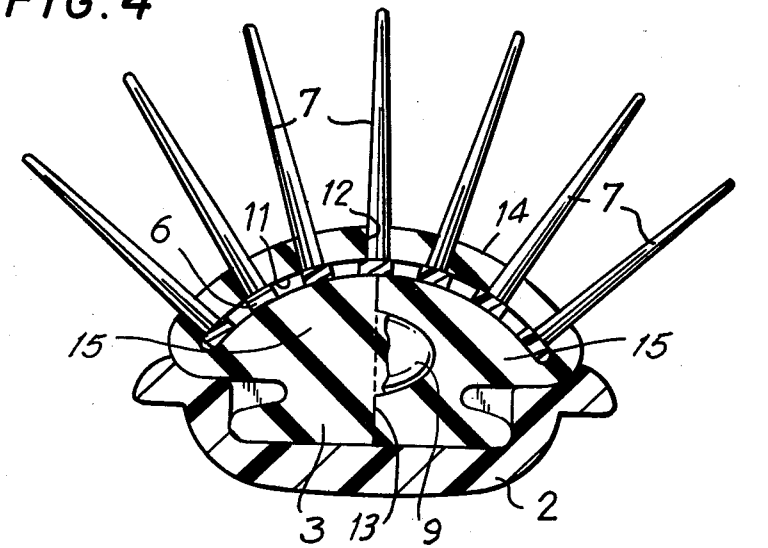
FIG. 4 is a cross-section along lines 4—4 of FIG. 1.
Figure 5:
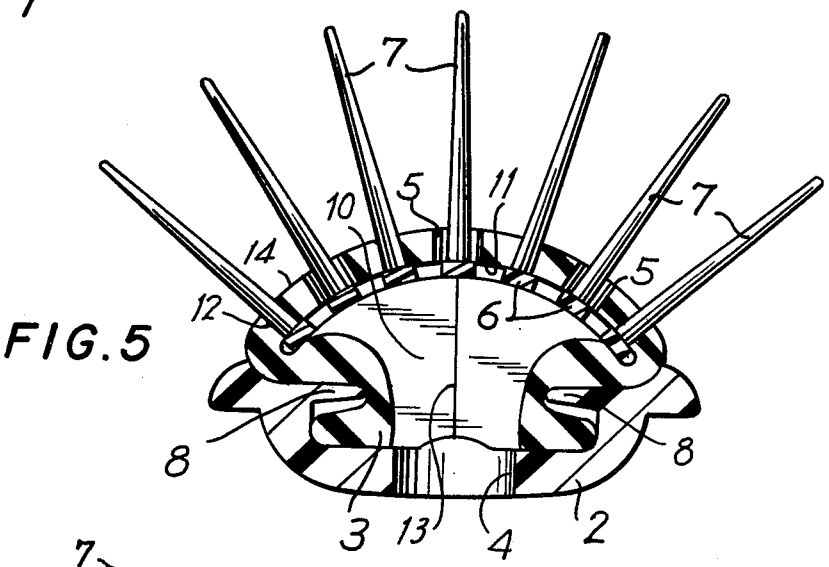
FIG. 5 is a cross-section along lines 5—5 of FIG. 1.
Figure 6:
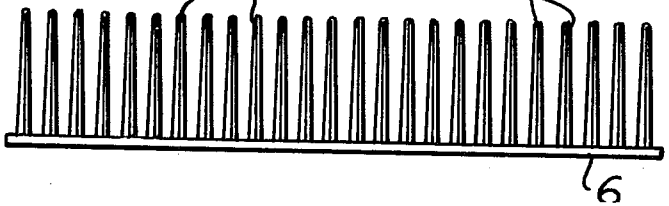
FIG. 6 is a side view of the track and bristles alone.
Figure 7:
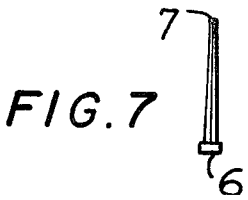
FIG. 7 is a front view of the track and bristles alone.

Referring specifically to FIG. 4, tracks 6 are pressed toward brush face 14 by cushion pads 15 so that the tracks 6 are held firmly in place in space 11. Cushion pads 15 fold under face 14 and meet at boundary 13. This arrangement allows the cushion to be separated so that access to space 11 is provided for easy insertion of the bristle carrying tracks 6. Nipples 9 are provided on one pad along boundary 13 to prevent slippage of the pads 15. Thus, cushion pads 15 provide a resilient support for tracks 6 and, in turn, bristles 7 when the user combs his hair.

Along the length of base 2, in-turned portions 8 (FIG. 5) provides a retaining runway for complimentary cushion 3 that allows cushion 3 to be slidably mounted for easy assembly and disassembly. Since the cushion 3 is flexible, it may also be snapped into the in-turned portions 8.

Figure 3:
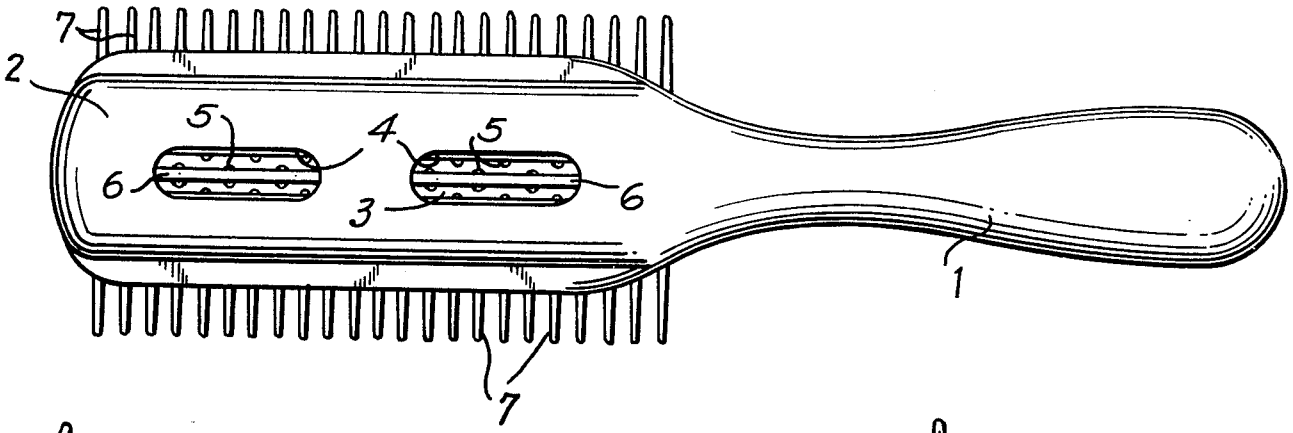
FIG. 3 is a plan view of the back of the invention according to its most preferred embodiment wherein the cushioned portion of the base has interior chambers.

Referring now to FIG. 3, it can be seen that the vents 4 on the back of base 2 are shaped so as not to obstruct the interior chambers 10 of cushion 3. Accordingly, a flow of air from above will pass through the vents 4 of base 2 into interior chambers 10 of cushion 3 and then flow past track 6 through opening 5 and around and between bristles 7 to dry the user's hair and scalp. When the bristles and cushion require cleaning, the cushion is removed by merely sliding it along the in-turned portions 8 of base 2 and the cushion separates along boundary 13 to provide easy access to space 11 and tracks 6 for cleaning. Alternatively, substantial cleaning can be achieved without removing cushion 3 simply by running water and cleaning agent through the vents 4 of base 2 if the base 2 and handle 1 are washable.

What is claimed is:

1. A hair brush comprising a handle and a base, said base being connected to said handle, an elastomeric cushion releasably secured to said base and having a brush face, at least one long narrow track within said cushion and having thereon a plurality of upstanding bristles substantially parallel to each other, said track being fixed relative to said base and said cushion and resiliently supported by said cushion, a plurality of openings through said cushion, each of said openings having only one of said bristles extending therethrough past said face, at least one vent through said base, said vent in communication with said openings, each of said openings being larger in cross section than each of said bristles and the width of said track whereby said track and bristles permit air to flow through said vent and said openings.

2. The hair brush according to claim 1 wherein said base further comprises at least one aperture through said face, said aperture having a bristle therein and being no larger than said bristle whereby said aperture grips said bristle and said track is fixed relative to said base.

3. The hair brush according to claim 1 wherein said cushion comprises pads that fold under said face to form a chamber and press said track toward said face.

4. The hair brush according to claim 1 wherein said cushion is detachably secured to said base.

5. A hair brush according to claim 1 wherein said track has a substantially rectangular cross section.

6. A hair brush according to claim 1 wherein said cushion has at least one interior chamber communicating with said vent and said openings.

7. A hair brush according to cliam 6 wherein said track is located in said chamber.

8. The hair brush according to claim 4 wherein an outer portion of said base is in-turned to provide a retaining runway along which said cushion is slidably retained.

9. The hair brush according to claim 1 wherein said track and said bristles are flexible plastic.

* * * * *